United States Patent [19]

Csongor

[11] Patent Number: 4,574,511

[45] Date of Patent: Mar. 11, 1986

[54] AMMUNITION LOADING DEVICE

[75] Inventor: Frank Csongor, 15 Morgan St., Wenham, Mass. 01984

[73] Assignee: Frank Csongor, Rye, N.H.

[21] Appl. No.: 568,379

[22] Filed: Jan. 5, 1984

[51] Int. Cl.[4] ..... F42B 39/06

[52] U.S. Cl. ..... 42/87

[58] Field of Search ..... 42/87, 88

[56] References Cited

U.S. PATENT DOCUMENTS 1,355,684 10/1920 Northover ..... 42/87

1,786,537 12/1930 Holek ..... 42/87

FOREIGN PATENT DOCUMENTS 379179 8/1932 United Kingdom ..... 42/88

770128 3/1957 United Kingdom ..... 42/88

*Primary Examiner*—Charles T. Jordan

*Attorney, Agent, or Firm*—Wolf, Greenfield & Sacks

[57] ABSTRACT

An apparatus for the rapid loading of ammunition into a magazine including a housing having open end to be received by the magazine. The housing has a receiving port into which the ammunition is disposed. There is preferably provided in combination with the apparatus a support pad for a plurality of rounds of ammunition with the support pad and ammunition being loaded into the receiving port of the housing. The housing has a means for limiting the position of the ammunition, typically a wall of the housing adapted to align the ammunition with the magazine. Means are provided supported at the housing remote from the open end thereof for contacting and driving the ammunition through the open end of the housing into the magazine.

12 Claims, 10 Drawing Figures

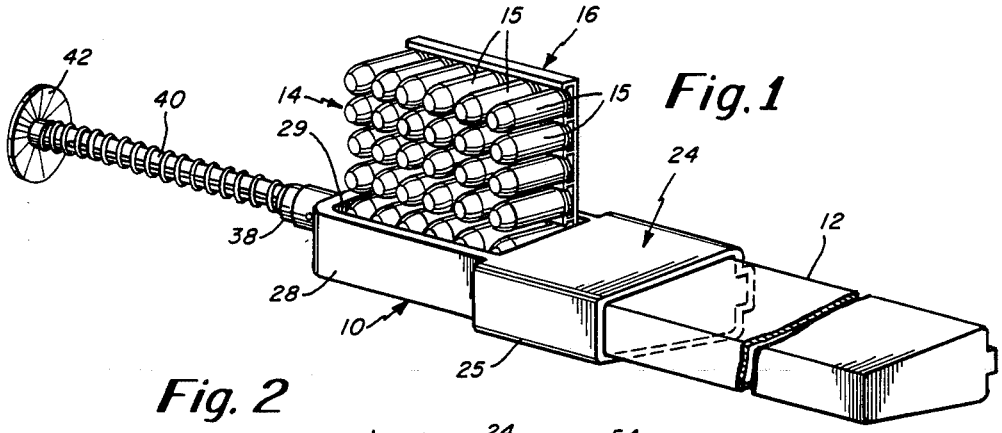
Fig. 1
Fig. 2
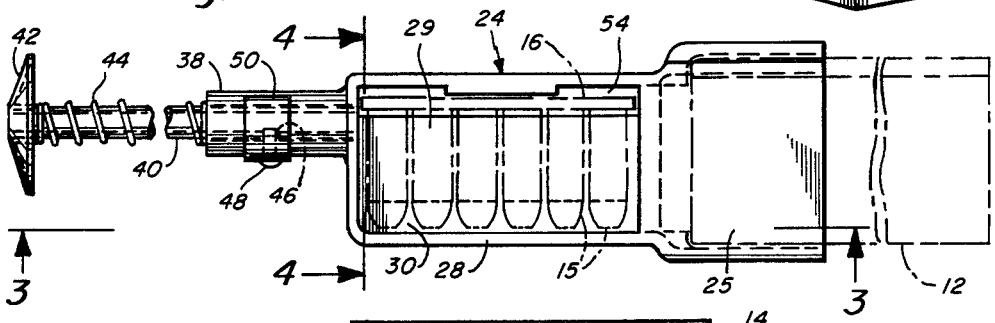
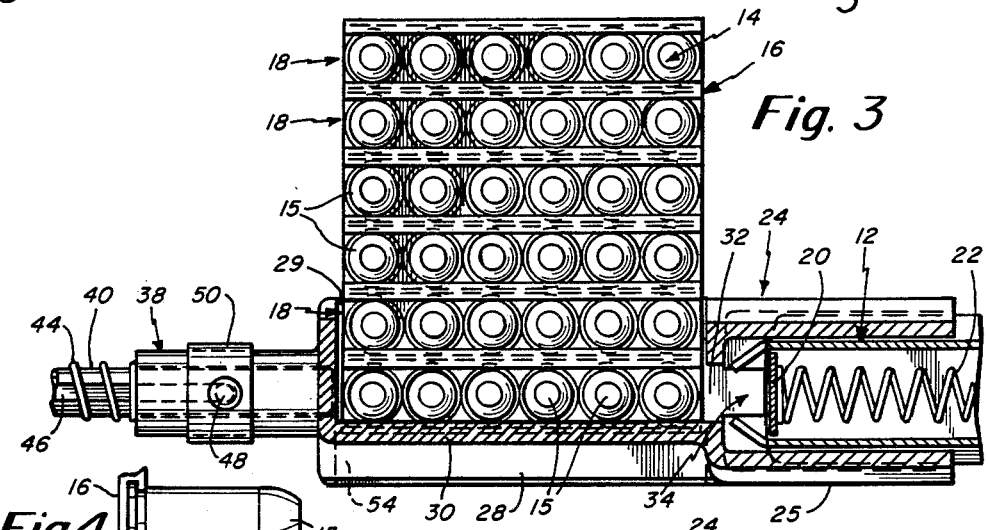
Fig. 3
Fig. 4
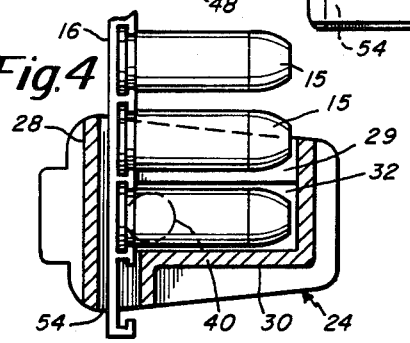
Fig. 5
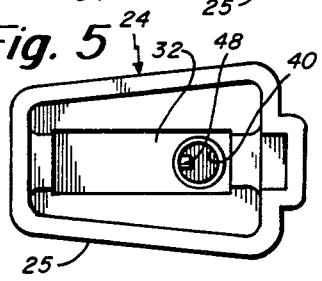

AMMUNITION LOADING DEVICE

BACKGROUND OF THE INVENTION

The present invention relates in general to a device or apparatus for loading ammunition into a magazine. More particularly, the invention is concerned with a device or apparatus which provides for the rapid loading of ammunition into a magazine used for holding a number of rounds of ammunition. In accordance with the rapid loading device of the present invention it is possible to load a complete magazine having, for example, 36 rounds of ammunition, in under three seconds.

A magazine is used for the purpose of storage of a number of rounds of ammunition. A magazine is typically used in conjunction with a firearm for the storage of the ammunition and the feeding thereof to the firing chamber of the firearm. By way of example, a magazine is used with a 38 caliber super automatic, a 30 caliber carbine and a military M16 rifle.

The loading of ammunition into a magazine is typically done by hand. This is a very time consuming process in which basically one round of ammunition at a time is loaded into the spring loaded magazine. Particularly in combat situations, there is a definite disadvantage in having to hand-load a magazine. Considerable time must be taken in loading the magazine before the magazine can be inserted into the weapon for use.

Accordingly, it is an object of the present invention to provide a device or apparatus for the rapid loading of a number of rounds of ammunition into a magazine.

Another object of the present invention is to provide a rapid loading device as in accordance with the preceding object and in which the magazine can be loaded quite rapidly in under three seconds; loading up to 36 rounds of ammunition.

A further object of the present invention is to provide an improved support pad for a number of rounds of ammunition which support pad with associated ammunition is adapted to be received by said loading device.

Another object of the present invention is to provide a support pad for an array of ammunition as in accordance with the preceding object and which is adapted to support a plurality of rounds of ammunition such as in a six by six array of ammunition rounds.

Still another object of the present invention is to provide an improved method of loading of a number of rounds of ammunition into a magazine, and in particular in which the method of loading is carried out rapidly.

SUMMARY OF THE INVENTION

To accomplish the foregoing and other objects of this invention there is provided an apparatus for the rapid loading of ammunition into a magazine. This apparatus comprises a housing having an open end to be received by the magazine. This open end of the housing is positioned relative to the magazine to enable passage of ammunition from the housing into the magazine. The housing has a receiving port into which the ammuntion is disposed. The housing is also provided with means for limiting the position of the ammunition so as to align the ammunition with the magazine. Means are provided supported at the housing remote from the open end thereof for contacting and driving the ammunition through the open end of the housing into the magazine. In combination with the apparatus is support means preferably in the form of a support pad having multiple channels for supporting a plurality of rounds of ammunition. The support means and ammunition are loaded into the receiving port of the housing. The support means as indicated previously, preferably has a series of channels for supporting an array of ammuntion rounds in multiple rows. The means for contacting and driving the ammunition is preferably a spring biased plunger which is adapted to contact a row of ammunition at a time. The subsequent rows of ammunition are fed by gravity so that after a row of ammunition is fed, the plunger retracts and the next row is fed into place by gravity and in readiness for feeding of the next row into the magazine.

In accordance with the method of the present invention there is provided a housing having an open end to be received by the magazine. The housing is positioned relative to the magazine to enable the passage of the ammuntion from the housing into the magazine. The ammuntion is loaded through a receiving port and it is loaded in a manner to limit the position of the ammunition so as to align the ammuntion with the magazine. The ammunition is then contacted and driven through the open end of the housing into the magazine. In accordance with the method of the invention the ammunition is preferably provided in an array supported by a support pad having multiple channels for holding the ammuntion in respective rows. The rows are contacted one at a time to load each row in sequence into the magazine.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is a perspective view showing a preferred embodiment of the rapid loading device of the present invention in association with a magazine;

FIG. 2 is a top plan view of the apparatus of FIG. 1;

FIG. 3 is a cross sectional view through the apparatus housing as taken along line 3—3 of FIG. 2;

FIG. 4 is another cross sectional view taken along line 4—4 of FIG. 2;

FIG. 5 is an end view looking in the open end of the housing of the apparatus;

DETAILED DESCRIPTION

Figure 6:
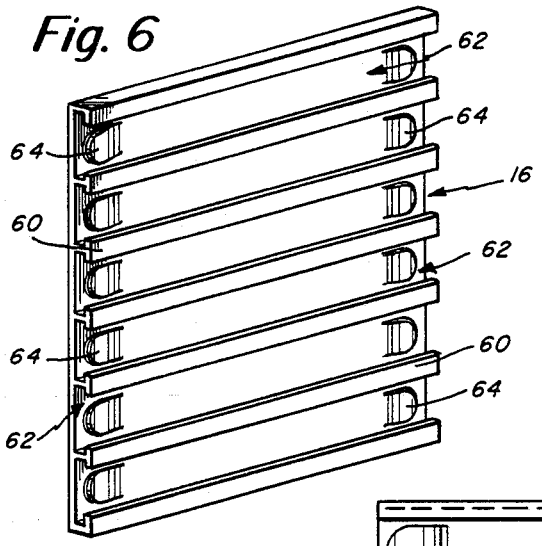
FIG. 6 is a perspective view of the support pad for the multiple rounds of ammunition.
Figure 7:
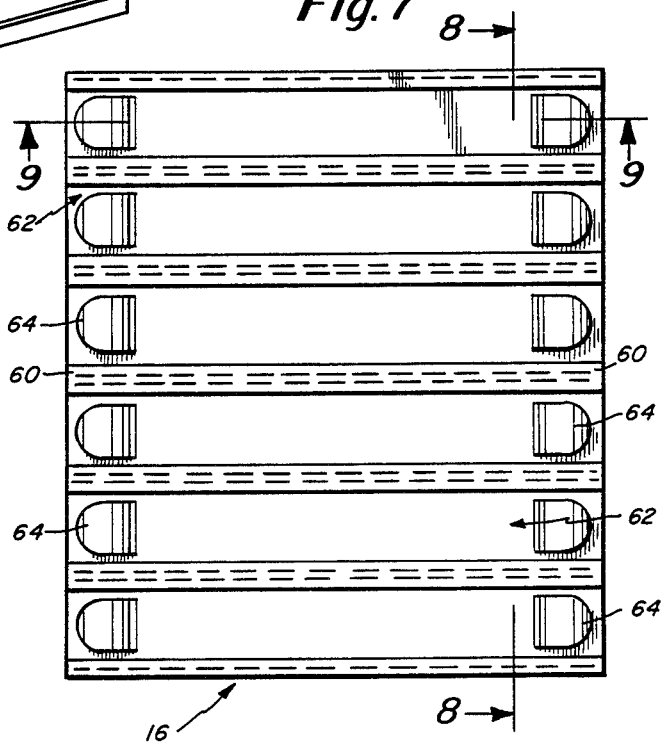
FIG. 7 is a plan view of the pad of FIG. 6.

Reference is now made to the drawings and in particular to FIG. 1 which shows a perspective view of the rapid loading device of the present invention. The device 10 of the invention is shown in association with a conventional ammunition storage magazine 12. The concepts of the present invention may be employed in connection with any size or style of magazine. By way of example, magazines that may be employed include those used in association with a 38 super automatic, a 30 caliber carbine, a military M16 carbine and other 9 millimeter or 45 caliber weapons. Some of these magazines have different shapes. The one illustrated in FIG. 1 has the general wedge shape and thus the device 10 is provided with a wedge-shaped opening. Other magazines may be more rectangular or may have other shapes and the device 10 is similarly shaped as to the opening that extends over the magazine.

FIG. 1 also shows an array 14 of ammunition including a plurality of individual ammunition rounds 15. All of the ammunition rounds are supported in a support pad 16. The details of the support pad 16 are illustrated in FIGS. 6–9 and are discussed in more detail hereinafter. It is also noted in FIG. 3 that the ammunition rounds 15 are disposed in respective rows 18. In the embodiment that is described there are six rows with each row having six rounds and thus there are a total of 36 ammunition rounds 15 supported by the support pad 16. FIG. 3 shows that the lowermost row 18 in position in the device 10 in readiness for being inserted into the magazine 12.

As mentioned previously, the magazine 12 is of conventional design and typically includes a sliding plate 20 schematically illustrated in FIG. 3 and some type of a spring 22 also schematically illustrated in FIG. 3. The rounds are urged against the plate and the magazine is constructed so that once the rounds are forced into the magazine they are retained in place in the magazine. Because the magazines that are used are of conventional design they are not shown in detail herein.

The rapid loading device 10 comprises a housing 24 having an enlarged open end 25 that is shaped to conform to the shape of the magazine 12. As indicated previously, in FIG. 1 the magazine 12 is of somewhat wedge-shape and thus the opening in the end 25 is also of similar shape with the inner dimensions of the opening corresponding in substance to the outer dimensions of the magazine. The fit of the magazine into the open end may be somewhat tight but is preferably not a force fit.

The housing 24 also includes an intermediate section 28 having at the top thereof an open receiving port 29 into which the ammunition array 14 is disposed. FIG. 3 shows the ammunition array 14 in position extending into the receiving port and having its downward position limited by means of the wall 30. FIG. 4 also shows the wall 30 of the intermediate section 28 and shows the lowermost row of ammunition rounds resting upon the wall 30. It is also noted in FIG. 4 that one of the rows thereunder has been stripped from the support pad 16 and has already been forced into the magazine. When this occurs the weight of the support pad and the remaining rounds simply feeds the next round thereabove into position such as in the position illustrated in FIG. 4 resting upon wall 30.

Reference is also made to FIG. 3 which shows the lowermost row 18 in line with the passage 32 that essentially bridges between the intermediate section 28 and the enlarged open end 25. It can be readily seen that the row of ammunition in place is directly in line with the passage 32 and in line with the opening 34 into the magazine 12.

The rapid loading device 10 also includes a support neck 38 integral with the intermediate section 28 extending therefrom. The neck 38 is hollow so as to receive the plunger shaft 40. The plunger shaft contacts the row of ammunition rounds and has at its outer end an actuating button 42. A biasing spring 44 extends about the shaft 40 between the button 42 and the neck 38. The shaft 40 is provided with an elongated groove 46 shown in FIG. 3. The groove 46 cooperated with the pin 48. The pin 48 is supported by a retaining collar 50 and the end of the pin 48 extends into the groove 46. At the inner end of the shaft 40 the groove 46 terminates as illustrated in FIG. 3 and thus the combination of the groove and the pin limits the outer travel of the plunger. The pin and groove also prevent rotation of the plunger shaft 40 in the neck 38. In FIGS. 1 and 3 the plunger is shown completely withdrawn. In order to force a row of rounds into the magazine the plunger is actuated by rapid hand action to strip a row of the ammunition from the support pad directing the row into the magazine.

When the plunger is struck by the hand as indicated the row of ammunition is forced into the magazine and is retained therein by virtue of the construction of the magazine. The spring 40 provides for an immediate return of the plunger. With the ammuntion having now been stripped from the first row, the array of ammunition with the associated support pad 16 falls by gravity until the next row contacts the wall 30 such as illustrated in FIG. 4. It is noted in FIG. 4 that the bottom row of ammunition has been stripped from the support pad 16, showing the support pad in that first row without any ammunition therein. FIG. 4 also shows a slot 54 adjacent to the wall 30 which enables passage of the support pad 16 out through the bottom of the housing. When the last row of ammunition has been contacted and forced into the magazine then the support pad 16 simply falls from and is free of the housing. The support pad 16 simply falls through the slot 54. The support pad 16 may then be refilled for subsequent use.

Figure 8:
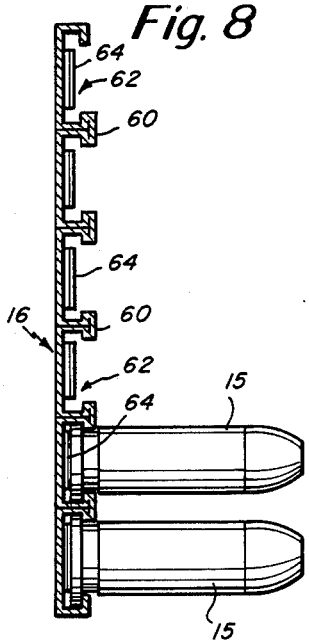
FIG. 8 is a cross sectional view taken along line 8—8 of FIG. 7 showing the individual support channels of the support pad.
Figure 9:
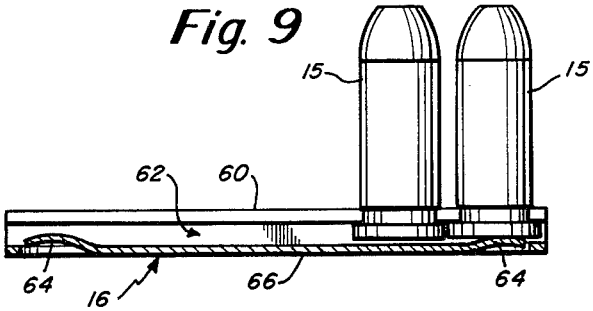
FIG. 9 is a cross sectional view taken along line 9—9 of FIG. 7 showing two rounds in place in one of the support channels.

FIGS. 6–9 show further details of the support pad 16. As indicated previously, this support pad is for supporting a plurality of rows 18 of ammunition. Thus, the pad is provided with T-shaped walls 60 that separate the pad into multiple round-receiving channels 62. By virtue of the walls 60 being T-shaped, and as illustrated in FIGS. 8 and 9, each of the rounds 15 fits within the channel 62 and is prevented from being lifted thereout by virtue of contact with the base of each ammunition piece with the underside extension of each of these T-shaped walls 60.

In order to prevent lateral movement of the rounds, there is provided at each end of each channel 62 a spring tab 64. Each of the spring tabs 64 is formed by punching out the base 66 such as illustrated in FIG. 9. FIG. 9 also illustrates one of the end rounds 15 being forced by the tab 64 so that the round is urged against the top flange of the T-shaped wall 60. The intermediate rounds between the two end rounds are retained in place by being limited between the two outside rounds. The spring action provided by the spring tabs 64 is sufficient to hold the ammunition in place in the support pad but is not too great a force so that when the plunger is used to extract the row of ammunition each row readily slides in its associated channel 62 from the support pad.

Figure 10:
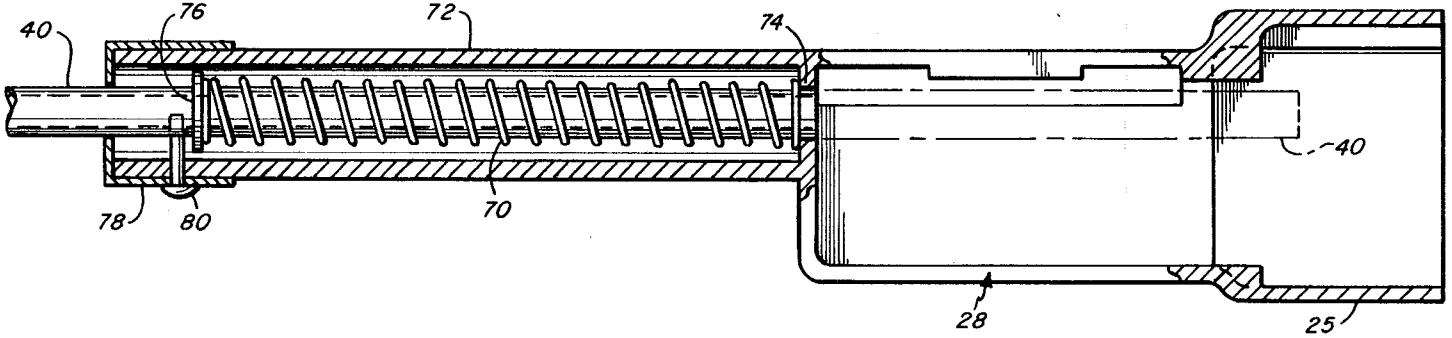
FIG. 10 is a plan view of an alternate embodiment in accordance with the invention in which the biasing spring is internally supported rather than externally supported as in FIG. 1.

Reference is now made to FIG. 10 which shows an alternate embodiment of the invention. Previously, in FIGS. 1–5 the return spring 44 was used to provide for the rapid return of the plunger in readiness for the next manual forcing step to force the next row of ammunition into the magazine. In the alternate embodiment of FIG. 10 like reference characters are used where applicable and in this embodiment there is provided a spring 70 about the plunger shaft 40. The spring 70 is contained within the neck 72 rather than externally as in the first embodiment. In this alternate embodiment the neck 72, as noted, is longer. The spring 70 is seated at one end against the wall 74 of the housing and is supported at the other end by a support disc 76 which is fixed to the shaft 40. FIG. 10 also shows the end member 78 and associated pin 80. In this embodiment the shaft 40 also preferably has an elongated groove into which the pin 80 extends. Again, this limits the outer travel of the shaft 40 and also prevents rotation of the shaft 40.

In FIG. 10 the shaft 40 is shown in solid in its normal rest position. FIG. 10 also shows in phantom the shaft being extended so as to force a row of ammunition into the magazine. The spring 70 causes a return of the plunger when the plunger is released.

In accordance with the present invention it is possible to adapt the housing, as mentioned previously, to receive magazines of any size and shape. Ammunition of any size and type can also be accommodated. If a larger round is to be accommodated then the receiving port may be made correspondingly larger. Also, if the magazine is larger then the housing is also made larger so as to accommodate it.

In accordance with another feature of the present invention, illustrated in FIG. 1 is a wedge shaped housing. As mentioned, the magazine could also be rectangular. The same mold can be used with an insert with the insert being used in order to provide the wedge shape. When the insert is not used then the mold provides for the usual rectangular shape so as to accommodate a rectangular magazine.

Also, in accordance with the invention the combination of plunger and return spring action enables loading extremely quickly. The entire array of ammunition can be loaded in less than three seconds quite easily. Each time that the plunger is moved manually the row of ammunition is entered into the magazine. The spring action returns the plunger and then the array falls until the next row is in place. This action repeats until the entire array of ammunition has been driven into the magazine. When this occurs then the support pad simply falls through the slot 54 and falls from the device housing.

Having described a limited number of embodiments of the present invention, it should now be apparent to those skilled in the art that numerous other embodiments are contemplated as falling within the scope of this invention. In the illustrative embodiments a spring has been used and means have been provided for preventing rotation of the plunger. In a more simplified embodiment the spring could be eliminated and also the means for preventing rotation could be eliminated.

What is claimed is:

1. Apparatus for rapid loading of ammunition into a magazine, comprising;

a housing having one end open to be received by the magazine and positioned relative to the magazine to enable passage of a row of rounds of the ammunition from the housing into the magazine, said housing having an intermediate section adjacent said one end and having means defining a receiving port into which the ammunition is disposed, said housing intermediate section having a bottom wall defining a means for limiting the position of the ammunition so as to align the ammunition with the magazine, said housing intermediate section further having upright wall means extending from said bottom wall to define the receiving port of dimension comparable to the row length and round length, in combination with support pad means for a plurality of rows of rounds of ammunition adapted to be loaded into the housing receiving port, said housing bottom wall having a longitudinally extending slot extending along one side of the bottom wall and adapted to receive the support pad means as the rows of rounds are extracted therefrom, and plunger means supported at the housing remote from the open end thereof for contacting at the base of a round and driving the ammunition through the open end of the housing into the magazine including means for biasing the plunger means to a retracted position.

2. Apparatus as set forth in claim 1 wherein said upright wall means extends to define a rectangular receiving port.

3. Apparatus as set forth in claim 1 wherein said support means comprises a support pad having a base and means defining a plurality of channels for the separate rows of ammunition.

4. Apparatus as set forth in claim 3 including means at each end on each channel for retaining the end rounds of ammunition in the channel.

5. Apparatus as set forth in claim 4 wherein said end channel retainers comprise end spring tabs.

6. Apparatus as set forth in claim 5 wherein said means defining the channels comprise spaced T-shaped walls.

7. Apparatus as set forth in claim 1 wherein said upright wall means extend to define a round accommodating compartment of a depth at least equal to one round.

8. Apparatus as set forth in claim 1 wherein said support pad is disposed orthogonally to said limiting wall.

9. Apparatus as set forth in claim 1 wherein said upright wall means extends to define a round accommodating compartment of a depth on the order of 1.5 rounds.

10. Apparatus as set forth in claim 1 wherein said plunger means is disposed, in its operable position, to at least partially overlie the bottom wall slot.

11. Apparatus as set forth in claim 1 wherein said plunger means includes a plunger shaft and said biasing mean comprises a spring disposed about the plunger shaft.

12. Apparatus as set forth in claim 1 wherein said biasing means comprises a spring contained in a neck portion.

* * * * *